US005180239A

United States Patent [19]

Bistrack

[11] Patent Number: 5,180,239

[45] Date of Patent: Jan. 19, 1993

[54] ADAPTABLE PRESSURE WRITING INSTRUMENT HOLDER

[76] Inventor: Carl Bistrack, 295 Gypsy La., King of Prussia, Pa. 19406

[21] Appl. No.: 652,067

[22] Filed: Feb. 7, 1991

[51] Int. Cl.[5] ..... B43K 23/00

[52] U.S. Cl. ..... 401/6; 401/88

[58] Field of Search ..... 401/6, 48, 88; 15/443, 15/437

[56] References Cited

U.S. PATENT DOCUMENTS

| | | | |
|---|---|---|---|
| 41,495 | 2/1864 | Eastman | 15/443 |
| 78,655 | 6/1868 | Eastman | 15/443 |
| 336,644 | 2/1886 | Hollwede | 15/443 |
| 338,239 | 3/1886 | Wyche | 15/443 |
| 340,382 | 4/1886 | Smith | 15/443 |
| 365,810 | 7/1887 | Harris | 15/443 |
| 426,324 | 4/1890 | Ramsey | 15/443 |
| 794,329 | 7/1905 | Whitehouse | 401/6 |
| 880,510 | 3/1908 | DeLashaw | 15/443 |
| 1,197,289 | 9/1916 | Henry | 15/437 |
| 1,438,114 | 12/1922 | Hume | 15/437 |
| 2,497,418 | 2/1950 | Schroeder | 15/437 |
| 3,373,509 | 3/1968 | Brass | 401/6 X |
| 3,510,949 | 5/1970 | Christy | 401/6 X |
| 3,947,977 | 4/1976 | Bishop | 401/6 X |
| 4,035,865 | 7/1977 | McRae et al. | 401/6 X |
| 4,111,566 | 9/1978 | Kenwell | 401/48 X |
| 4,165,896 | 8/1979 | Hunt | 294/25 |
| 4,167,347 | 9/1979 | Hoyle | 15/427 |
| 4,386,448 | 6/1983 | Kohn | 401/6 X |
| 4,523,781 | 6/1985 | Brody | 294/25 |
| 4,602,885 | 7/1986 | Bischoff et al. | 15/437 |
| 4,606,484 | 8/1986 | Winter | 294/25 |
| 4,832,604 | 5/1989 | Rusk | 401/6 X |
| 4,917,517 | 4/1990 | Ertz | 401/6 |

FOREIGN PATENT DOCUMENTS

| | | | |
|---|---|---|---|
| 18815 | 8/1904 | Australia | 15/443 |
| 39911 | 9/1973 | Australia | 401/6 |
| 9562 | of 1895 | United Kingdom | 15/443 |
| 21931 | of 1907 | United Kingdom | 15/443 |
| 1340389 | 12/1973 | United Kingdom | 401/6 |
| 2194722 | 3/1988 | United Kingdom | 401/6 |

*Primary Examiner*—Steven A. Bratlie
*Attorney, Agent, or Firm*—Louis Weinstein

[57] ABSTRACT

A hand held adaptable pressure writing instrument holder for those persons with physical writing disabilities. The one piece unit is formed of a resilient material and contains a central core instrument path consisting of a circular bore hole with several flat slits enabling the insertion of a variety of instruments and adaptation to varying shapes. The body consists of a palm rest of oval egg shape which curves forward and under terminating in a perpendicular planar surface projection of sufficient size to allow for finger placement on this upper shelf. A vertical gripping surface connects the upper shelf to another lower perpendicular planar surface in parallel with the first. The planar surfaces include a compound bevel downward and with a decided right or left hand slope. The elements from the top palm rest to the lower planar surface are volute in nature forming a right or left-hand spiral. At the rear of the device, the palm rest curves aft and under terminating in the beveled vertical detent. The hand specific side, the right side in this case, forms a concave surface for a distance necessary to accommodate fingers, joints, knuckles, or hand webbing between finger joints, then flaring outward joining the lower planar surface. From the upper rear bevel detent, the back forms a slightly convex surface as it connects with the bottom. The body and instrument path is reversible and exposes the larger circumference area of the palm rest along with other control surfaces.

6 Claims, 10 Drawing Sheets

ADAPTABLE PRESSURE WRITING INSTRUMENT HOLDER

BACKGROUND

1. Field of Invention

This invention relates to hand held writing instrument holders, more specifically to those holders designed for persons with writing disabilities and handicaps, that offer more writing comfort and alternative methods of holding and applying pressure control to a narrow instrument other than the conventional use of the thumb, index and middle finger of the writing hand.

2. Description of Prior Art

There are many people who have difficulty holding and using writing instruments or can not use them because of limited, varying, or minimal hand or finger gripping ability. This may be the result of a number of conditions ranging from brain impairment to severe cases of arthritis of the hand, digital deformities, missing fingers, or merely a single sprained, cut, broken or cramped finger or hand. Hand injuries are very common among younger persons, as is arthritis to the older population. It has been found through AARP (American Association of Retired Persons) research that Arthritis, or inflammation of the joints is the most common condition affecting people in the United States. Inflammation of the finger joints will affect functionality to varying degrees from a mild pain causing discomfort from the prolonged holding and use of a writing instrument, to the more severe form of Arthritis which may cause a deformity of the fingers rendering them misshapen for pratical use in grasping or holding a narrow object using the conventional three fingers in applying pressure for the control of an instrument. Due to the wide range of needs it is not an easy or practical task to design a device which will take into account the variety and shapes of support needed to accommodate every instance of hand or finger injury or deformity. No such device has been made readily available for everyday use, nor is there a device that does give the appearance in use of a prosthetic device used by "cripples", that is simple and common, that is inexpensive to manufacture to the extent that it might be a "use and throw away" off-the-shelf disposable item, as common as a pen or pencil.

A number of devices have been patented which resolve a very specific comfort range, or type of impairment or designated task such as:

"Implement Holding Cuff" by Bischoff et al. U.S. Pat. No. 4,602,885 July, 1986 which is designed for the physically handicapped and will contain their hand, fingers, and instrument within a controllable cage or cuff to cradle a non functioning hand.

"Rolling Support For Writing Instruments" of Russell A. Schroeder, Jr. U.S. Pat. No. 2,497,418 February, 1950 whose rolling hand rest writing device which must be in contact with the writing surface, is not a hand held device, and concentrates on those with total digital impairment or hand paralysis shifting the emphasis to arm and shoulder control for writing ability.

The J. F. Hume, U.S. Pat. No. 1,438,114 December, 1922 "Writing Implement" whole hand palm size sliding ball with embedded pen designed to teach proper penmanship while supporting the hand, and assumes that normal digital control exists.

The patent of H. G. Eastman, U.S. Pat. No. 78,655 issued June, 1868 "Improvement In Pen Holders" employs a unique egg shaped palm rest coupled with slip in finger holders for the correct positioning of the pen, but the design makes no allowance for pressure of the palm to aid in the writing process, nor for non-finger use, or for other than gripping the instrument by conventional methods.

The "Tool Holding Appliance" Winter et al, U.S. Pat. No. 4,606,484 issued Aug. 19, 1986 utilizes a device which is strapped on to the palm of the hand and holds very specifically designed tools and utensils and intended for persons with limited hand mobility. A more significant invention in this field, by Brody, U.S. Pat. No. 4,523,781 issued Jun. 18, 1985 was specifically designed for those persons suffering from arthritis and others having reduced gripping ability. Brody's design, a palm size, barrel shaped clam shell type instrument holder is meant to be held and manipulated within the palm of the hand, and lacking any digital dexterity at all, the device can be strapped onto the hand. Brody's design assumes that a normal "palm" or open palm does exist and has limited application for controlled downward pressure through other than the attachable hand strap or gripping of the barrel, and does not make allowances for more adaptable hand positioning as the individual deformity may require for comfort or for unorthodox use of those parts of the hand such as the "V" joints between fingers, or the palm and inner finger joint only, without the use of the actual fingers, or the use of any two desired fingers however closely or widely spaced, or unbending fingers that may still be usable for downward pressure and control of a writing instrument.

There are other numerous patented writing instrument holders which tie on, strap on, or slip on or through, but again, each to overcome a specific infirmity or add a degree of ease and comfort. Based on prior art then, no hand held writing instrument holder device is available that has the adaptability of my writing instrument holder, or offers the many simultaneous combinations as is needed by the user, the many compound vertical, horizontal, beveled, rounded, concave, convex or volute surfaces for variable open finger grasping positions, or degree of control from parts of the finger exerting pressure and manipulation, or the capability of using the palm of the hand in conjunction with an opposing member in an unorthodox manner for holding and guiding a writing instrument or other, providing the restoration of writing abilities, even though minimal prehensile ability exists and absolutely unorthodox, highly individualized methods are called for and employed.

SUMMARY OF INVENTION OBJECTS AND ADVANTAGES

The principal object of my invention is to provide a writing instrument holder designed to lend advantage to those not having full use of their hands and fingers, to offer a constant variety of alternative compound surfaces, and simultaneous combinations and options in applying pressure and control to a writing instrument other than the conventional combined use of the thumb, index and middle finger of the writing hand in a tight grip pattern.

Another object is to provide an instrument holder which conforms to the individual's hand and varying method of applying controlling pressure, however unorthodox, accomplished through the design, materials and construction.

Another object is to provide for adaptability through greater resiliency of the construction materials of a wider range of writing instruments, but not limited to such, and other instruments and tools such as artist brushes and knives, eating utensils, drafting tools, personal hygiene implements, etc.

Another object of my invention is to provide an everyday readily attainable and personal answer in this invention to temporary writing disabilities such as finger and hand cramps, sprains or fractures in splints or hand casts.

Another object is to provide a consumer marketable instrument holder which is simple in construction, inexpensive to produce, and is dependable in use.

Yet another object of my invention is to provide a convenient easily carried and personal means of achieving the end result without the image or stigma of using a prosthetic like device.

Other objects advantages and very novel features will become apparent from the detailed descriptions of use accompanying the drawings.

DETAILED DESCRIPTION OF THE EMBODIMENTS

Brief Description of the Drawings

FIG. 3A Top view of instrument holder with hand in position indicating palm rest, and upper and lower finger shelves.

Figure 1:
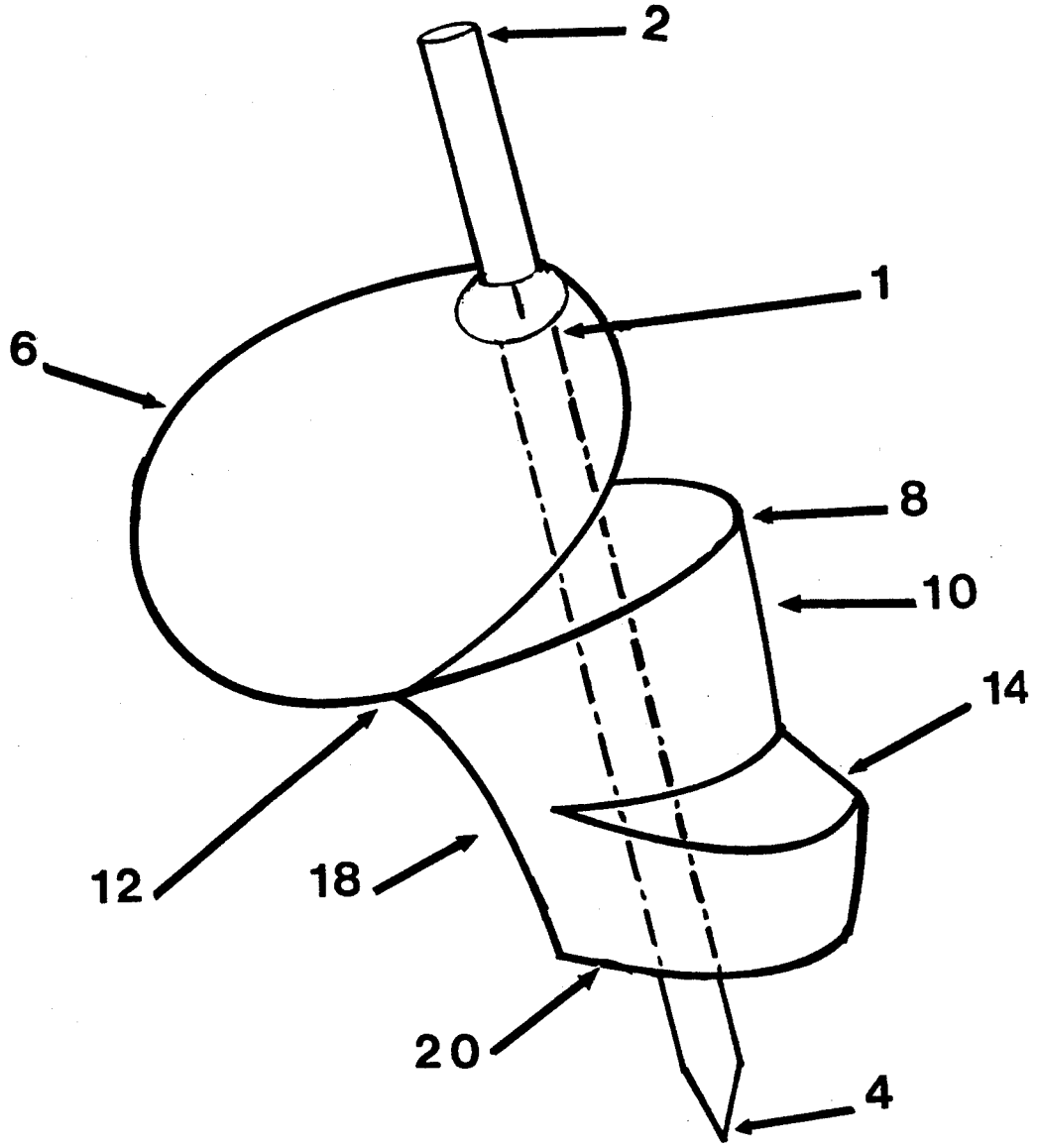
FIG. 1 Right side view of instrument holder.

Holder and writing instrument are shown in an upside down position, the writing instrument reversed. In this position downward pressure of the palm of the hand is used to accomplish control of the instrument in conjunction with wrist or finger guidance, or minimum pressure from the inner thumb and base of the index finger. No actual finger pressure is needed for the use of the instrument in this position.

REFERENCE NUMERALS IN DRAWINGS

1 Instrument Core
2 Top of writing instrument
4 Tip of writing instrument
6 Palm rest
8 Upper finger shelf
10 Vertical Side grasping surface
12 Upper Beveled Detent
14 Lower Finger Shelf
16 Concave Side
18 Back
20 Bottom All of the illustrations shown are of a writing instrument holder device manufactured hand specific, in this case, for the right hand. The preferred construction material is of lightweight semi rigid plastic, foam rubber, or composite material exhibiting qualities such as resilience, tear resitance ability to compress and conform to a variety of instrustments of varying shapes inserted into the instrument holder path #1, and have the ability to decompress or spring back to its original shape after repeated uses. The material will also be porous to allow for long periods of use without causing finger or hand sweating. In addition the materials should have a tendency to conform, or give slightly under the individual style of applying pressure to, in effect, mold to that persons style of use and their physical finger/hand characteristics. Weight of the device should be such that it comfortable to hold extended periods of time, and is not a negative comfort factor in the writing process. The size of the writing instrument holder should be such that it fits into the palm of the hand easily, and is large enough to accept all fingers.

Figure 1A:
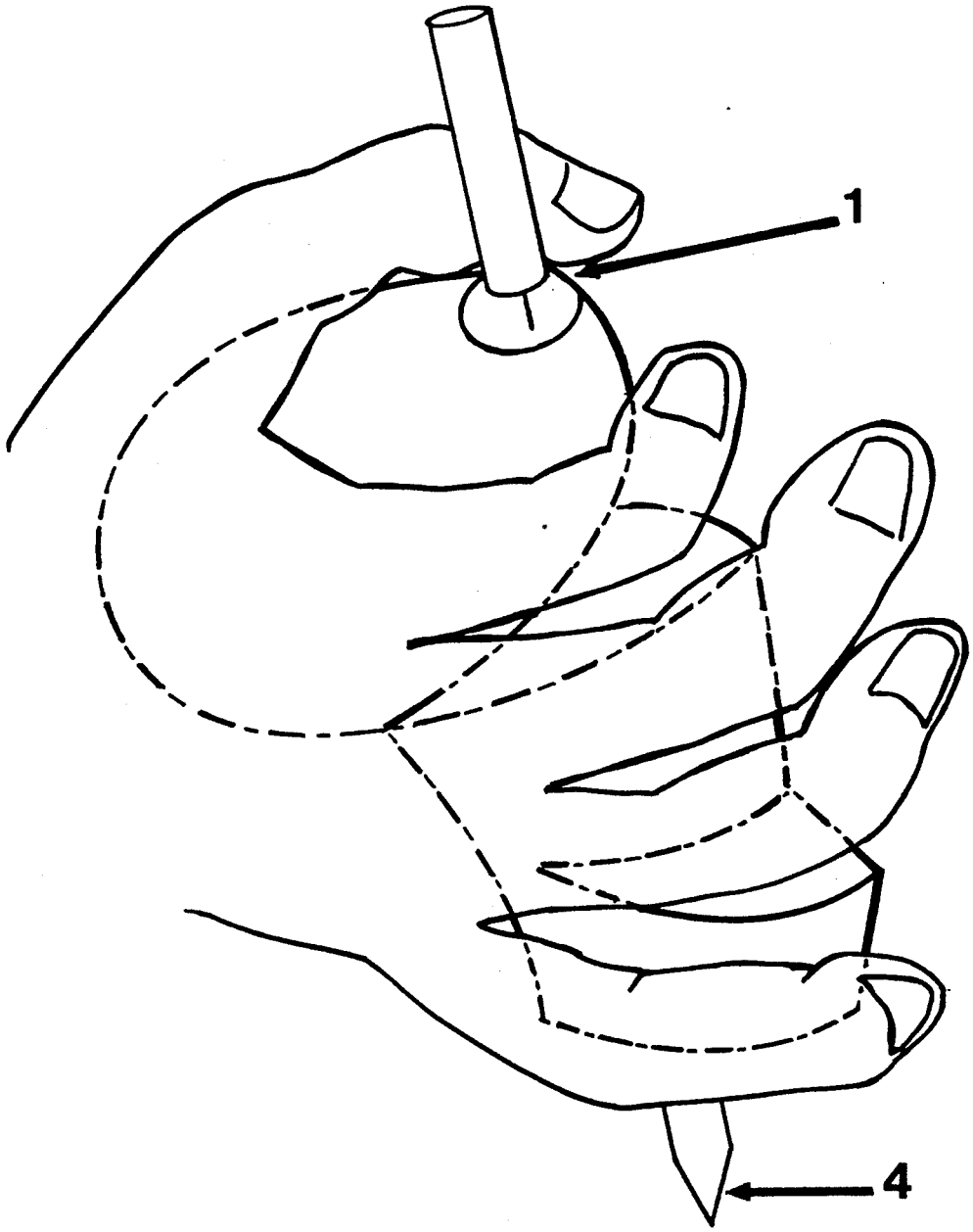
FIG. 1A Instrument holder in use by right handed person indicating hand, palm and finger position options.
Figure 3:
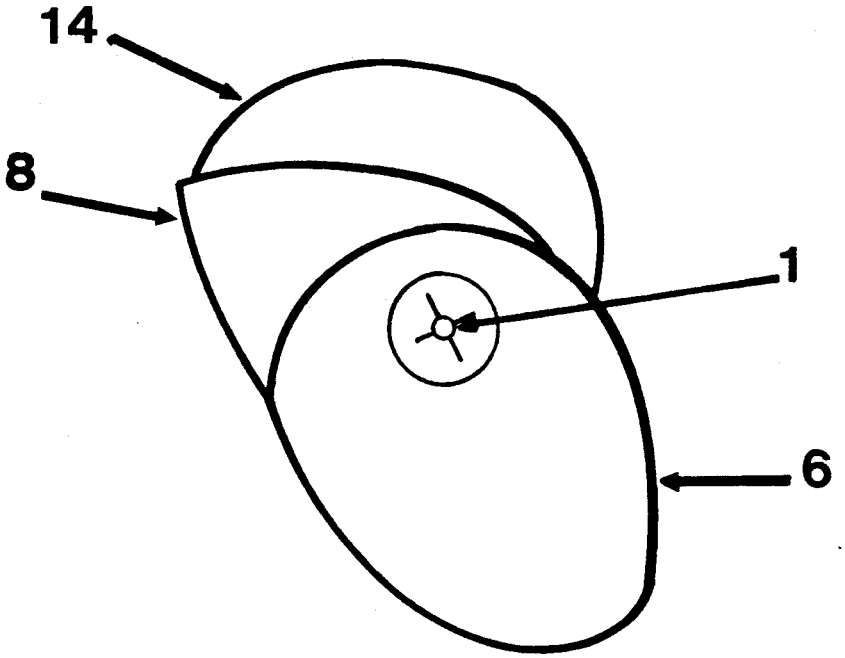
FIG. 3 Top view of instrument holder.

In FIG. 1 a right hand unit is shown. For greatest utility, offering finger control on one side or the other, the unit must be manufactured hand-specific, left or right, but not precluding a double sided unit. All figures shown are a right hand device. Here the right side view of FIG. 1 will serve to clarify the reason for hand-specific design. Starting from the top palm #6 to the bottom finger shelf rest #4 there is a decided twist to the right in a spiral staircase like form. As shown in FIG. 1A when the palm of the hand is placed over the palm rest #6 the fingers of the right hand will conform or fall naturally into this spiral staircase pattern. Merely grasping or draping fingers, useable or non usable fingers, over the form will automatically position them on the device for either resting/holding and/or for downward pressure use and control. FIG. 1 shows a standard angle of use. The instrument core 1 is designed to accept a variety of small width relatively smooth instruments ranging from circular to square to flat or to compound shapes, through a combination of the material's resiliency and its ability to conform to varying surfaces. Seen clearly in the top view FIG. 3, the core consists of a small bore hole which expands to accept a round instrument, and two flat cross slits through the length of the instrument which expand to accept flat to square instruments. The bore hole cross slit width dimension may vary with the resilience of the material used. The preformed pathways enable the material to expand and conform more easily to the shape of the instrument without straining or tearing. FIG. 1, The instrument is inserted into the core by pushing the instrument into either the top or bottom of the device which is clearly marked, until the desired length of instrument tip 4 is reached.

Figure 3A:
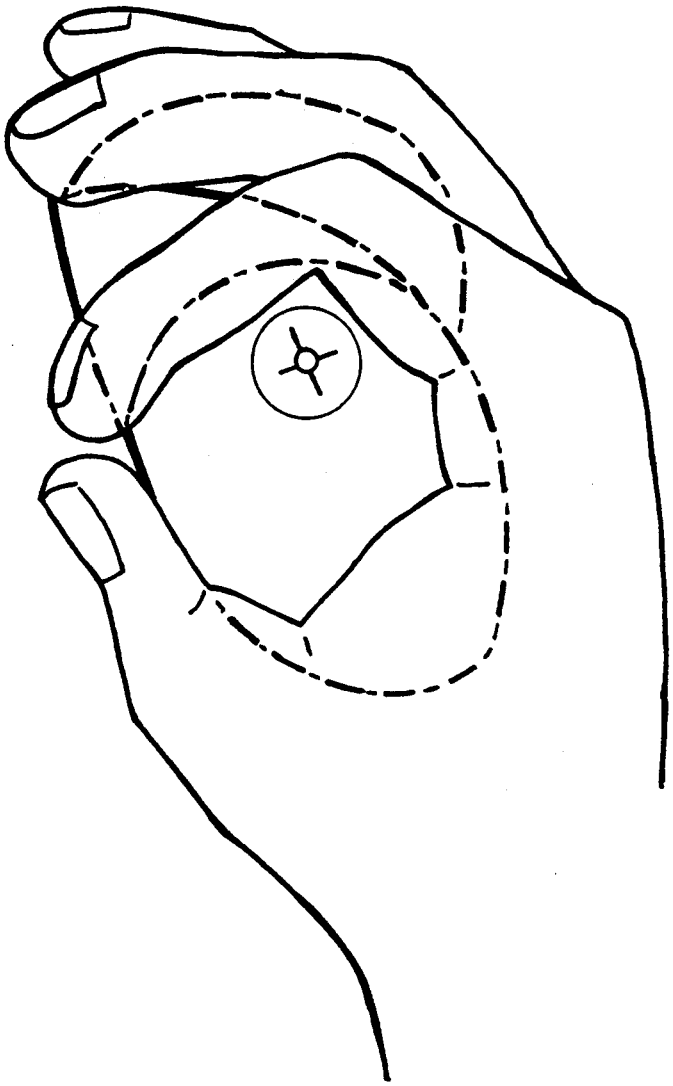

Using this position as an example shown in FIG. 1A for writing, the hand is draped over the palm rest. Fingers unbent or bent slightly to conform to the device are positioned on the upper finger shelf 8 lower finger shelf rest 14, with the option of placing the small finger also if desired. Depending on the mobility and use of the fingers, the vertical grasp 10 may be held for further control. In the top FIG. 3 the instrument core slit marking 1 can be seen, the oval shaped palm rest 6 is offset to the right with the finger shelf rest 8 and 14 directly under the palm rest. A normal hand position is illustrated in FIG.3A with the fingers on the upper and lower shelves. Depending on the dexterity of the fingers and the need to support them, rotating the device slightly counter clockwise toward the straighter side allows the fingers to be supported in a straight unbent position; rotating the device clockwise, the fingers may encircle the grip the device in an open handed grasp.

Figure 2:
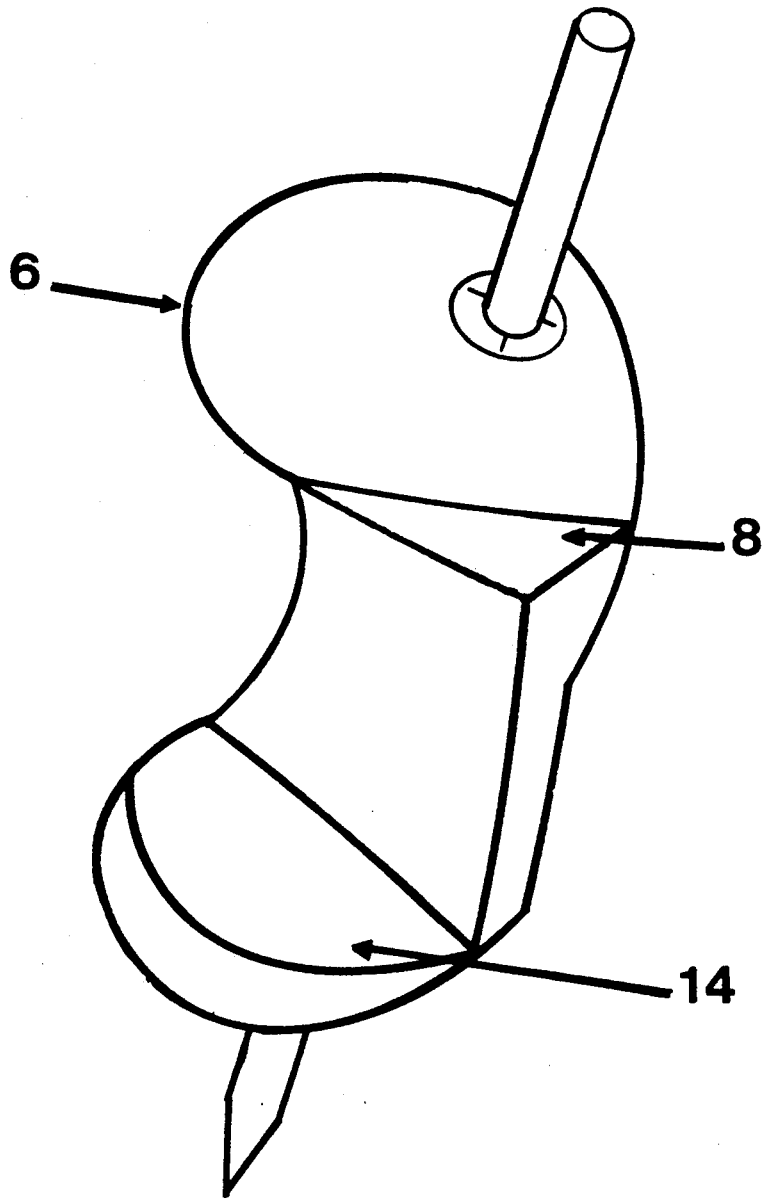
FIG. 2 Front view of instrument holder.

A front view of the device in shown in FIG. 2. Here the oval shaped palm rest is seen to be offset in the direction for use by right handed person. The finger shelves 8 and 14 are spiraled to the right hand, and they are bevled or sloped downward allowing finger pressure, created naturally by placement of the fingers on the platform to act as a counterbalance to the palm pressure adding more control in the writing or instrument handling process.

Figure 4:
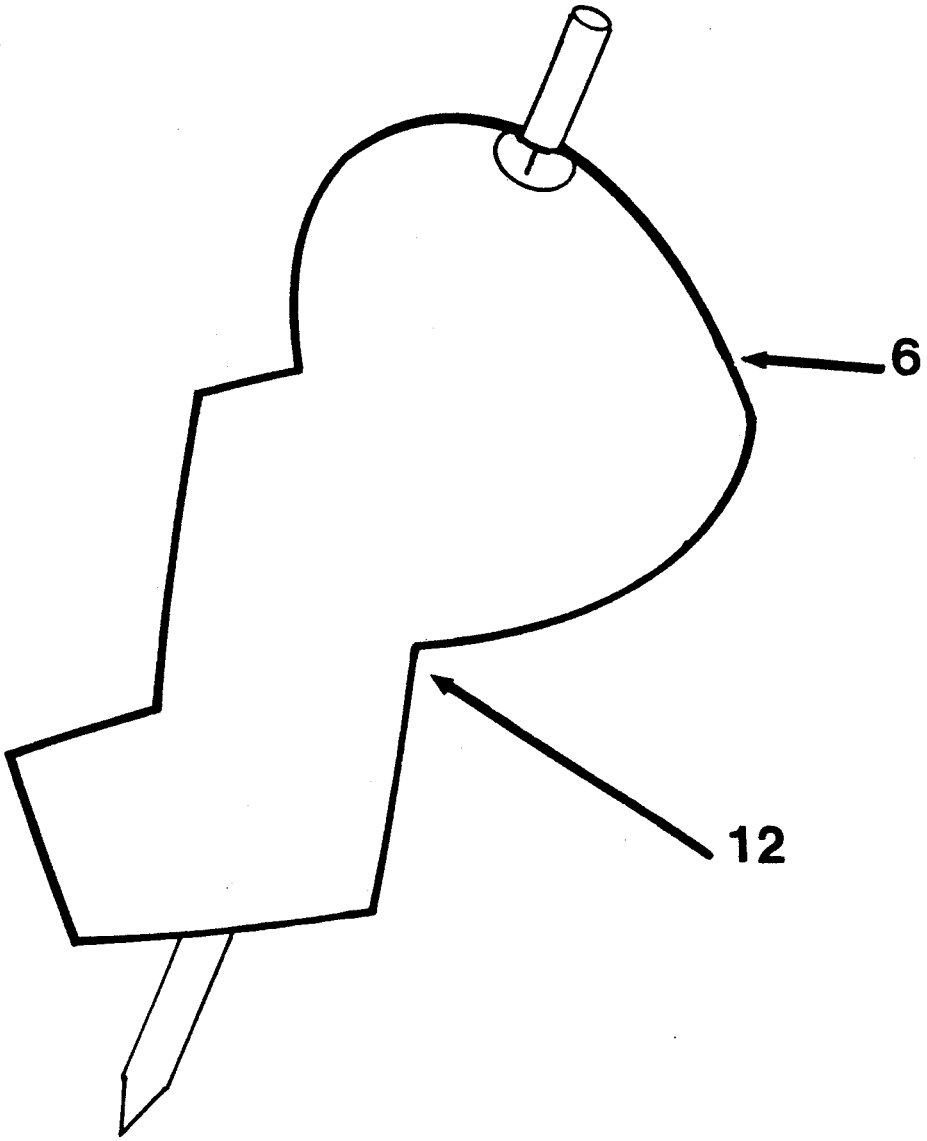
FIG. 4 Left side view of instrument holder.
Figure 4A:
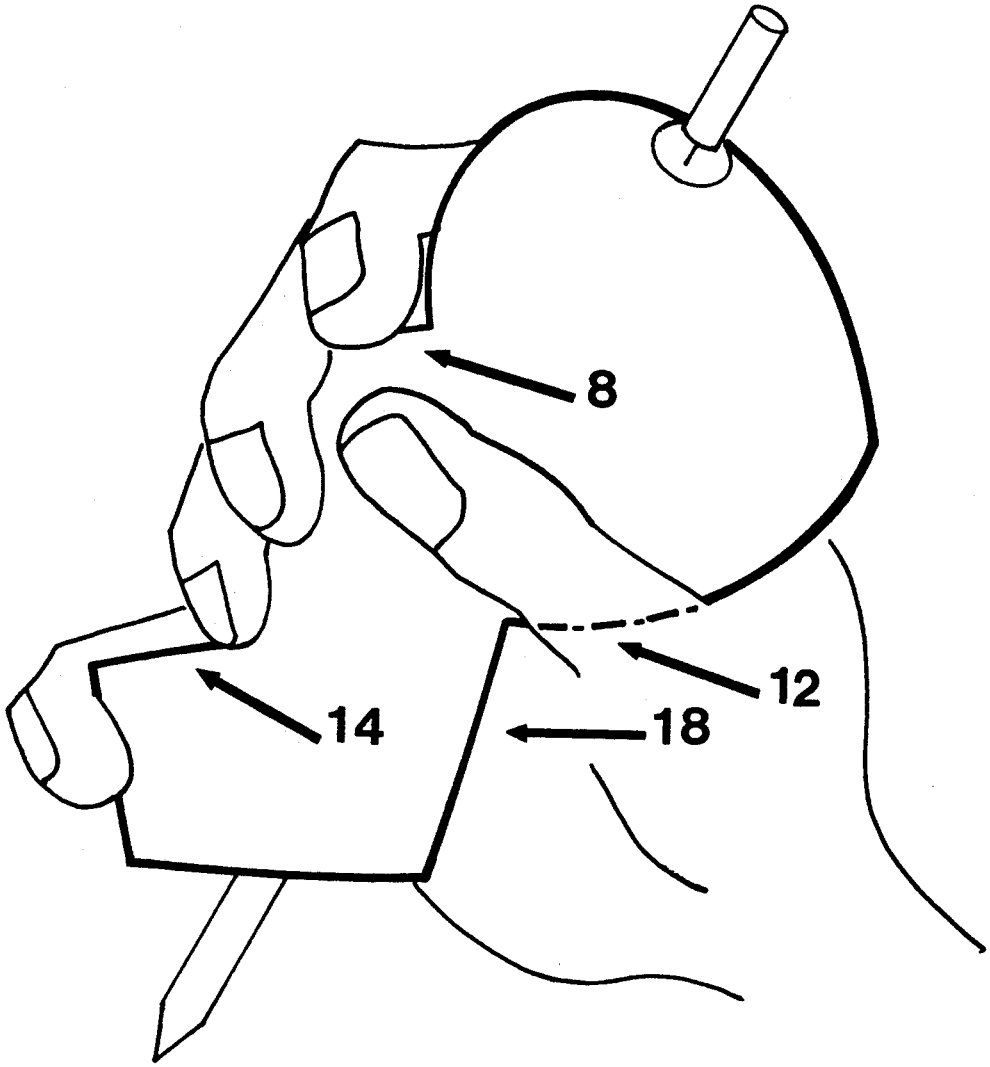
FIG. 4A Left side view with hand in position.

The left hand view FIG. 4 exposes the underside curvature 12 of the oval shaped palm rest 6. This area is designated as the upper beveled detent and serves as an upper hand stop limit keeping the hand from slipping upward when used as illustrated in FIG. 4A, the thumb is shown under the palm rest, fingers tips exert pressure at rest 8, and 14, while the upper detent 12 and back 18, provide counterbalance and control.

Figure 4B:
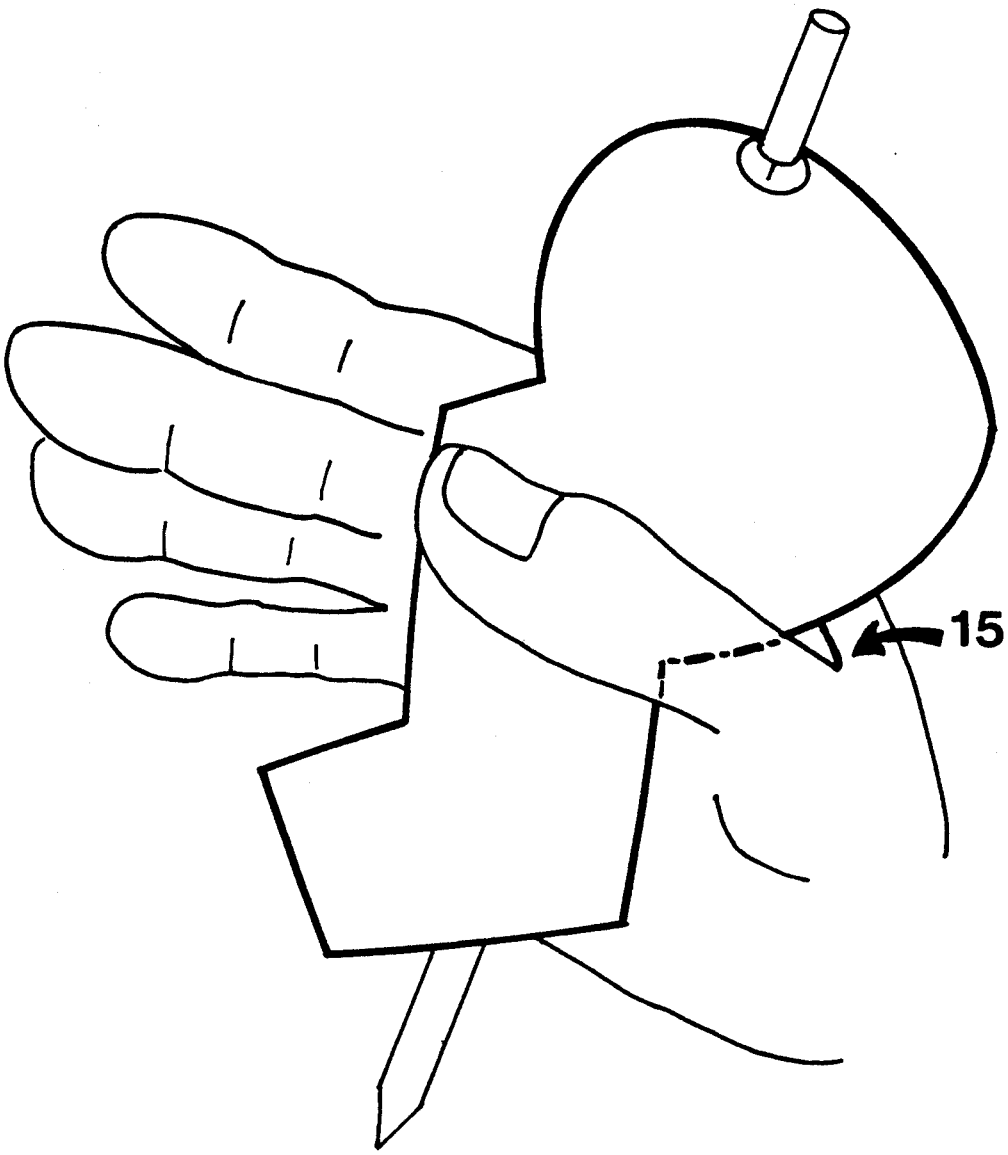
FIG. 4B Left side view, another alternate method of grasping the instrument holder at the concave contoured surface showing that full instrument use can be accomplished using only the pressure applied from the inner thumb and base of the index finger, or webbing between fingers. No actual finger pressure is needed for the use of the instrument.
Figure 5:
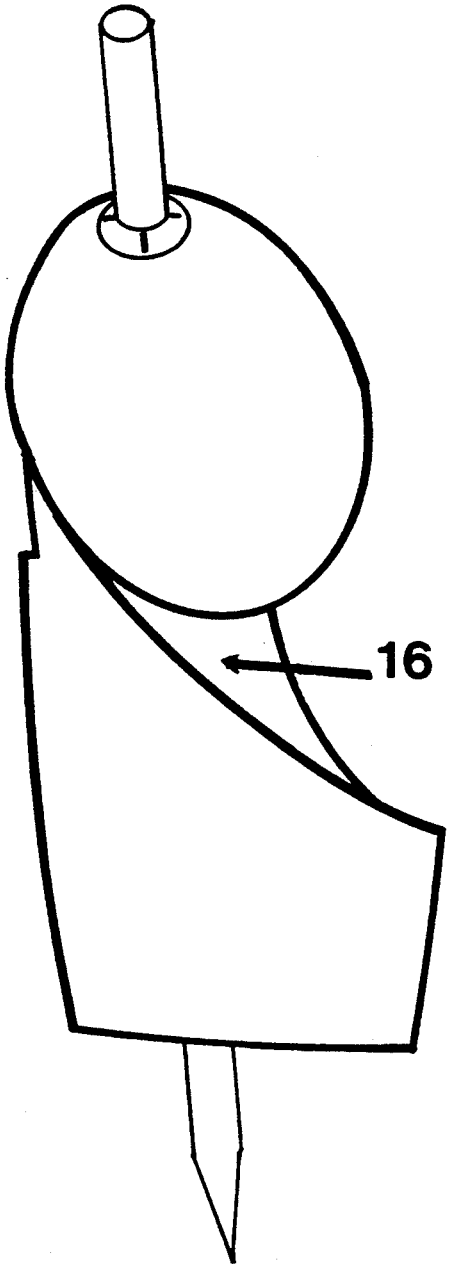
FIG. 5 Back view of Instrument holder.

In an example of where deformities may cause clenched or tighten fingers not able to close on a writing instrument, or hand set in a cast with limited use of fingers, either of which might allow only the use of the "v" between the the thumb and index finger but not the palm of the hand, the device may be FIG. 4B with the thumb joint low on the left side of the device. The pushing inward naturally forces the device into the vee 15 on the hand between finger joints. As this occurs, the webbing between fingers conforms to the concave side surface 16, FIG. 5, and further secures the device adding control of the writing instrument. The inner curve of the vee and the joint of the index finger follows the concave contour, and it combination with the upper detent 12, the device is cradled securely without additional controls/fingers needed.

Figure 6:
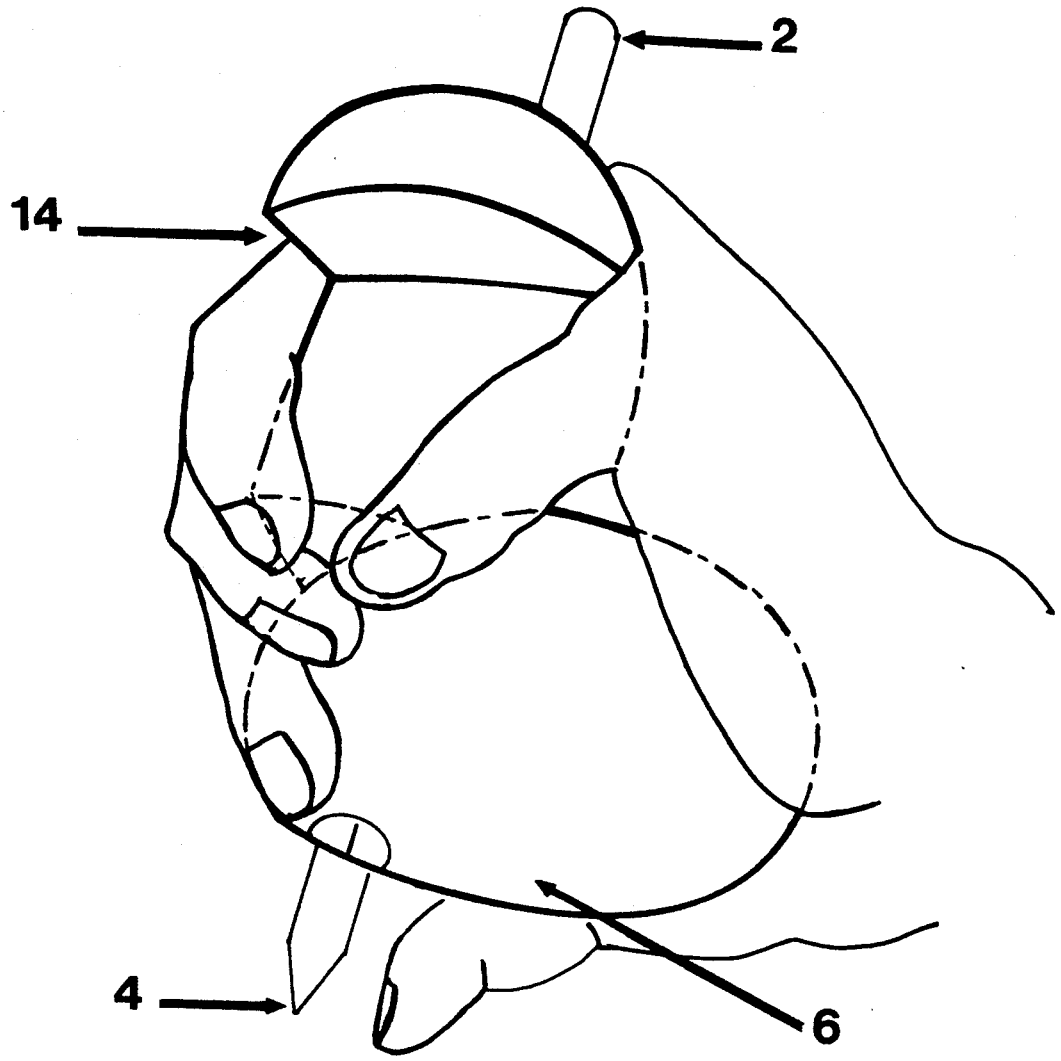
FIG. 6 Reverse view, alternate method of grasping instrument holder.

In almost identical situation, with the fingers clenched, or with the fingers in an open position but with little gripping ability, and where the palm of the hand is usable and desirable. FIG. 6 shows that the writing instrument holder may be held reversed, upside down with the palm rest 6 in the downward position. The writing instrument 2 and 4 is removed and reversed also. The object here again is to grasp the device in the vee or webbing of the hand between finger joints. In this configuration the aft underside of 6 becomes the palm rest surface and is now a larger circumference object easier to grasp and is another method of control. The concave side 16 becomes an aid in guiding and nesting the holder between the webbing or vee of the hand. Control of the device in this position is accomplished by grasping the larger object the palm rest 6, which might be desirable for those persons with limited finger joint mobility and using the vee between finger joints in grasping the concave surface 16 and using downward pressure on the plam rest.

Because of ergonomic simplicity inherent in the design numerous combinations with variations of pressure control and push-pull manipulation are possible with the multiple planes and control surfaces provided to allow for maximum flexibility for individual need.

Although the descriptions and illustrations above contain numerous specifications and illustration for use, these should not be constructed as limiting the scope of the invention but as merely providing illustration of some of some of the presently preferred embodiments of this invention.

What is claimed is:

1. A hand-held adaptable pressure writing instrument holder especially adapted for use by person with manual or digital impairments, comprising:

a one-piece body shaped to conform to the curvatures of various parts of the hand and the natural tendencies of the fingers of the hand and containing a plurality of integrated control surfaces;

said body being of a size capable of fitting into the palm of the hand and large enough to enable all of the fingers of the hand to placed upon said body;

said body being formed of a resilient material so as to be adaptable to conform to the application of pressure thereto;

said body having a central through-bore of a predetermined diameter enabling adaptation to a variety of shapes and instruments capable of being inserted into said bore;

said body having a top end and a bottom end;

said bore having a first end terminating in the opening at the top end of said body and second end terminating in an opening in the bottom end of said body;

said top end comprising a substantially egg-shaped palm rest;

said bottom end having a curved convex surface surrounding said bottom opening and curving upwardly generally in the direction toward said top end;

a lower finger shelf comprising a lower finger shelf surface located a predetermined distance above said bottom end opening and partially encircling said bore;

the outer periphery of said lower finger shelf surface being joined to the upwardly curve portion of said bottom end;

an intermediate body portion extending between said top and bottom ends having a lower rearward portion curving upwardly and outwardly from said bottom end toward said palm rest;

an upper finger shelf positioned between said top end and said lower finger shelf and comprising an upper finger shelf surface partially encircling said bore;

said upper finger shelf extending in an outward direction and merging with a top forward portion of said intermediate body portion;

an inner end of the upper finger shelf curving upwardly toward said palm rest;

said lower and upper finger shelves having curved forward peripheral portions which partially encircle said bore and extending generally in the direction of a forward side of said body;

said intermediate body portion having a forward side extending between said upper and lower finger shelves along the forward side of said body.

2. The holder of claim 1 wherein the upper finger shelf is offset a predetermined angle from a longitudinal axis of said egg-shaped top end and wherein said lower finger shelf is offset a predetermined angle from said upper finger shelf.

3. The holder of claim 2 wherein the offsets of said upper and lower finger shelves relative to said egg-shaped top generally define a spiral configuration, the direction of twist of said spiral being a function of the hand with which the holder is to be used.

4. The holder of claim 1 wherein said egg-shaped rest has curved undersurface portion remote from the top end thereof which merges with the intermediated body portion to form a bevelled vertical detent.

5. The holder according to claim 1 wherein the surface of the finger shelves are inclined relative to a longitudinal axis of the bore.

6. The holder according to claim 1 wherein said finger shelves comprise substantially planar surface which are volute in nature, forming a specific right or left spiral.

* * * * *